US006799680B2

(12) United States Patent
Mak

(10) Patent No.: US 6,799,680 B2
(45) Date of Patent: Oct. 5, 2004

(54) VACUUM SEALED CONTAINERS

(75) Inventor: Chi Kin John Mak, Hong Kong (HK)

(73) Assignee: The Holmes Group, Inc., Milford, MA (US)

( * ) Notice: Subject to any disclaimer, the term of this patent is extended or adjusted under 35 U.S.C. 154(b) by 116 days.

(21) Appl. No.: 10/116,981

(22) Filed: Apr. 5, 2002

(65) Prior Publication Data

US 2004/0124113 A1 Jul. 1, 2004

(51) Int. Cl.[7] ..... B65D 81/20
(52) U.S. Cl. ..... 206/524.8; 383/109; 428/35.2
(58) Field of Search ..... 206/524.8, 484.1, 206/484; 383/63, 105, 109, 113; 428/35.2, 131, 141, 156

(56) References Cited

U.S. PATENT DOCUMENTS

| | | | | | |
|---|---|---|---|---|---|
| 2,778,171 | A | | 1/1957 | Taunton | |
| 2,778,173 | A | * | 1/1957 | Taunton | 206/524.8 |
| 3,411,698 | A | | 11/1968 | Reynolds | |
| 3,973,063 | A | * | 8/1976 | Clayton | 428/35.2 |
| 4,702,376 | A | * | 10/1987 | Pagliaro | 206/524.8 |
| 4,859,519 | A | * | 8/1989 | Cabe et al. | 428/131 |
| 4,939,151 | A | * | 7/1990 | Bacehowski et al. | 206/484.1 |
| 4,941,310 | A | | 7/1990 | Kristen | |
| 5,199,795 | A | * | 4/1993 | Russo et al. | 383/113 |
| RE34,929 | E | | 5/1995 | Kristen | |
| 5,554,423 | A | | 9/1996 | Abate | |
| 5,618,111 | A | * | 4/1997 | Porchia et al. | 383/63 |
| 5,698,250 | A | | 12/1997 | DelDuca et al. | |
| 5,928,560 | A | | 7/1999 | DelDuca et al. | |
| 6,054,153 | A | | 4/2000 | Carr et al. | |
| 6,394,652 | B2 | * | 5/2002 | Meyer et al. | 383/118 |

* cited by examiner

*Primary Examiner*—Luan K. Bui
(74) *Attorney, Agent, or Firm*—Hoffman & Baron, LLP

(57) ABSTRACT

Container or bags for sealing food or other objects are made from a composite material. The material has an outer oxygen-impermeable layer and an inner heat-sealable layer. The two layers are joined by an intermediate adhesive layer that is stiffer than either the inner or outer layer. Other embodiments may be made of a single layer of heat-sealable material that resists the flow or air or oxygen inside the container. Channels on the sides of the container or bag form an interconnecting network and allow a flow of air and oxygen for evacuation of the bag. The material may be laminated in a continuous fashion as a tube wherein bags are made by cutting and sealing the material at desired intervals.

8 Claims, 10 Drawing Sheets

+

=

+

=

VACUUM SEALED CONTAINERS

FIELD OF THE INVENTION

The present invention relates to packaging materials and in particular, to heat-sealable packages that are intended for anaerobic or vacuum packing of perishable foods and other products.

BACKGROUND OF THE INVENTION

Preservation of food and food portions is important for a variety of economic, health, and convenience reasons. Food can be stored for longer periods of time if oxygen is excluded and the harmful effects of oxygen on food are minimized. Containers have long been used to store and transfer perishable foods and other products on their way to market for purchase by consumers. After perishable foods, such as meats, fruits, and vegetables are harvested, they may be placed into containers or atmospheres to protect them from the spoiling effects of oxygen. Containers are also used by retailers or by consumers to store and transport individual servings or left-over portions of food. In these instances, it may be even more useful to exclude oxygen and thus retard spoilage of the food item. Some solutions to these problems are outlined, for example, in U.S. Pat. No. 2,778,171.

The environment in which the food or food product is stored is probably the most important factor in preserving the food item. It is important to maintain proper temperatures, but the atmosphere in which the food product or other item is stored has the greatest effect on the preserved life of the product. By providing an appropriate atmosphere within the storage container, the food or other item can be better preserved when maintained at the proper temperature. A preservative atmosphere will also help when the item is exposed to variations in temperature, such as freezing and thawing, or when it is subjected to the temperature variations in a cargo hold, such as in an airplane or a ship. The molecular or atomic content of the gases in the atmosphere may be the single most important factor in the preservation process.

Maintaining low levels of oxygen is generally preferred because it is well known that the fresh quality of meats can be preserved longer under anaerobic conditions than under aerobic conditions with typical levels of oxygen. Maintaining low levels of oxygen minimizes the growth and multiplication of aerobic bacteria, and thus contributes to longer life of a food product, such as meats or cooked food items. Minimizing oxygen also retards oxidation generally, and can provide an ideal atmosphere for storing many other types of products subject to oxidation or corrosion.

These products may include electrical or electronic products. Items such as printed circuit boards, integrated circuits, or even passive items, such as resistors or capacitors, may have very fine copper traces that depend on preservation of the trace for proper functioning of the circuit. Corrosion and oxidation from even a "normal" atmosphere may be damaging to such products, especially when combined with temperature variations, assembly operations, and contamination. In-process cleaning operations, combined with preservative techniques, may extend the performance and the life of such products and their higher assemblies.

What is needed is a packaging solution that eliminates oxygen from a storage environment, leaving the environment suitable for storage of food products, as well as other products, in an atmosphere that is largely free of oxygen. This solution should be cost-effective, as well as handy and convenient, and preferably available both to retailers and consumers.

BRIEF SUMMARY OF THE INVENTION

One embodiment of the invention is a container comprising first and second panels, each panel defining inner and outer surfaces, said panels joined together to form a package for placing a product therein. Each of said first and second panels further comprises a first plurality of non-interconnected channels on an inner surface of said first panel. There is a second plurality of non-interconnected channels on an inner surface of the second panel, the second plurality different from the first plurality in at least one of orientation and extent, the first and second pluralities cooperating to form evacuation paths.

Another embodiment of the invention is a tubular element for forming a container. The tubular element comprises a first member formed from a gas-impermeable, heat-sealable material. There is a second member formed from a gas-impermeable, heat-sealable material. The first member is bonded to the second member along a first and a second side of said first and second members. There is a first plurality of non-interconnected channels on an inner surface of the first member and a second plurality of non-interconnected channels on an inner surface of the second member, said second plurality different from said first plurality in at least one of orientation and extent, said first and second pluralities cooperating to form evacuation paths.

Another embodiment of the invention is a method of protecting an object. The method comprises placing the object into a container, the container comprising first and second panels, each defining inner and outer surfaces, joined together to form a package for placing a product therein, each of said first and second panels further comprising a gas-impermeable, heat sealable material, a first plurality of channels on an inner surface of said first panel, and a second plurality of channels on an inner surface of said second panel. The method also includes evacuating the container and sealing the container using said first and second heat-sealable layers.

Another embodiment of the invention is a method for manufacturing a sealing material. The method comprises placing a first film of a gas-impermeable material and placing a second film of a heat-sealable material. The method then comprises adhering the first film to the second film with a layer of adhesive material to form a sealing material. The method then comprises forming channels on the material, said channels forming a network on said material.

Another embodiment is a container of a type comprising first and second rectangular gas-impermeable panels, each defining inner and outer surfaces and both panels sealingly joined together at three common adjacent peripheral edges and not joined at a fourth peripheral edge. Joining the panels forms a gas-impermeable container having an interior chamber and an open edge for placing a product therethrough and into the interior chamber. An improvement to the container comprises a first network of non-interconnected channels on the inner surface of the first panel and a second network of non-interconnected channels on the inner surface of the second panel, wherein said channels of said first network communicate with said channels of said second network when the first and second panels are joined, to form a master network of interconnected channels in communication with the open edge to allow gas to be withdrawn therethrough from the interior of the container.

DETAILED DESCRIPTION OF THE PRESENTLY PREFERRED EMBODIMENTS OF THE INVENTION

Figure 1:
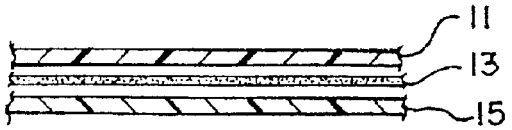
FIG. 1 is a cross-sectional view of a first embodiment of the invention.

Embodiments of the present invention are directed to containers for food products and other objects from which it is desirable to exclude air or oxygen. As shown in FIG. 1, one embodiment is a laminated structure 10, composed of a first layer 11 of a material which is oxygen or gas impermeable, that is, oxygen or other gases do not diffuse or are not otherwise transported through the material. Such materials include nylon, certain polyesters, and polyvinylidene chloride. A second layer 15 of a heat-sealable material is useful for providing a seal to prevent oxygen and other gases from leaking back into the package after it has been evacuated and sealed. Heat sealable materials according to the present invention need not be oxygen impermeable, and may include polystyrene, polyethylene, and polypropylene. Polyethylene is preferred. These layers 11, 15 are preferably laminated together with an adhesive layer 13. The adhesive is any adhesive suitable for reliably joining adherend material layers 11 and 15. Other embodiments may use only a single-layer of material, such as polyethylene or very-low density polyethylene (VLDPE), rather than a layered or laminated structure.

Figure 2:
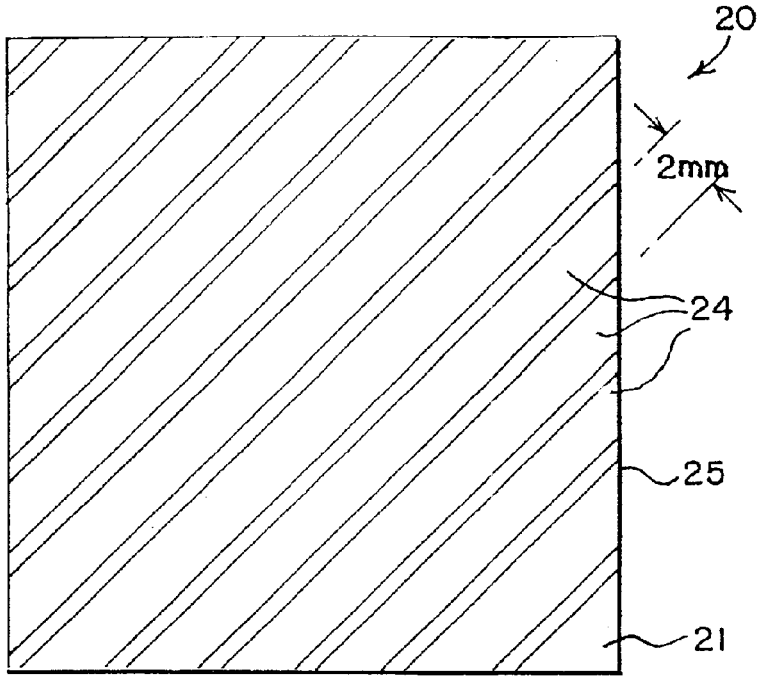
FIG. 2 is a plan view of the embodiment of FIG. 1.

Once the layers have been joined into a laminated structure, the resulting material is preferably embossed or otherwise processed to form a series of parallel, non-interconnected channels on the heat-sealing layer. Alternatively, a series of channels or depressions may be placed onto the inner surface in the case of a single-layer embodiment, or on the innermost layer. The heat-sealing layer will typically have a lower melt temperature or viscosity index than the gas or oxygen-impermeable layer. In the preferred embodiment, the channels are formed at an angle of about forty-five degrees to a longitudinal edge of the material, as shown in FIG. 2. The embossed or extruded material 20 is composed of inner, heat-sealable layer 21 bonded with an adhesive layer and an outer oxygen-barrier material (not shown in this plan view). In the preferred embodiment, channels 24 extend at an angle of approximately forty-five degrees to a longitudinal edge 25 of the material. Channels for evacuation may also result by forming protrusions that stand out from the surface of the inner layer, the channels formed between protrusions.

Figure 3:
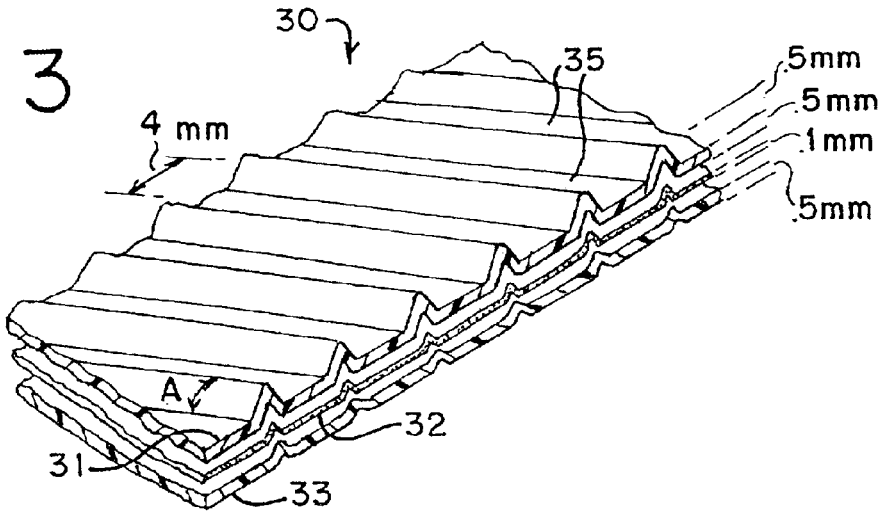
FIG. 3 is a perspective view of a second embodiment of the invention.

The materials may vary in thickness depending on the degree of protection desired. The layers may vary from about 0.025 mm (0.001 inches) thick to as much as 1 mm (0.039 inches) thick or even thicker, in each layer. The spacing of the channels may vary from 0.005" (0.13 mm) to 0.25" (6 mm). FIG. 3 depicts a layered material 30 suitable for storing perishable goods, in which the layers 31, 33, join by thin adhesive layer 32, are about 0.5 mm thick (0.020") with spacing at about 1 mm (approx. 0.039"). In this embodiment, layer 31 is the inner layer made of a heat-sealable film while layer 33 is the oxygen-barrier material. The walls of the channels 35 preferably extend at an angle to the surface of the heat-sealable material 31 at the bottom of the channel, depicted as arrow A. The channels themselves are preferably U-shaped and preferably symmetric, forming an angle of from about 30 degrees to about 60 degrees to the material surface, more preferably about 45 degrees. They may also be V-shaped or have any other convenient shape.

Figure 4:
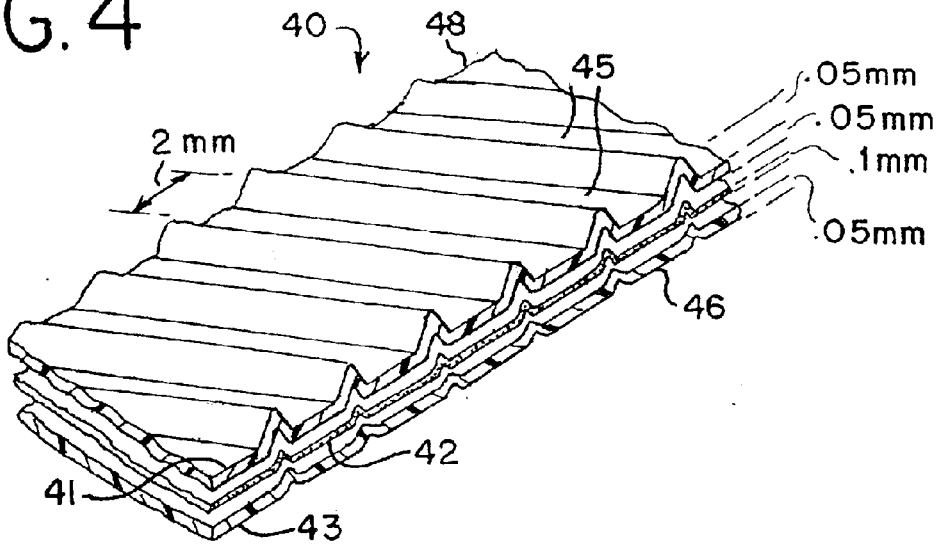
FIG. 4 is a perspective view of another embodiment of the invention.

The depths of the channels placed are preferably no greater than the thickness of the heat-sealable material, or less. Thus, in the embodiment of FIG. 3, the heat-sealable layer 31 is about 0.5 mm thick and the channels are about 0.5 mm high. In this embodiment, spaces between channels are about 4 mm. Another embodiment is depicted in FIG. 4, with sheet 40 having layers 41, 42, 43, having channels 45 at an angle of about forty-five degrees to the edges 46, 48 of the material 40. FIG. 4 also depicts the thickness of layers 41, 43 at about 0.05 mm (0.002 inches thick) with an adhesive layer 42 about 0.1 mm thick (approx. 0.0004 inches thick). The channels 45 are about 0.05 mm (approx 0.002 inches) deep, about the thickness of the heat-sealable layer 41.

Figure 5:
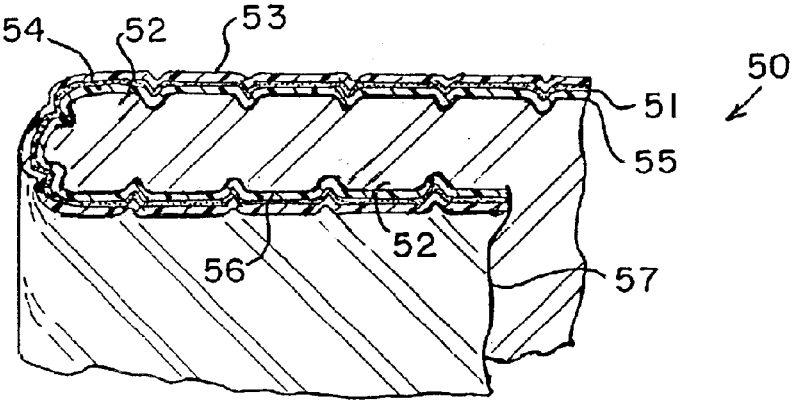
FIG. 5 is a perspective view of the embodiment according to FIG. 3 or 4 in a folded shape.

In the alternative, a single layered sheet may be folded lengthwise to form a tubular element. A tubular element may be a length of laminated material in the form of a flattened pipe or tube. As shown in FIG. 5, a folded embodiment according to FIG. 3 or FIG. 4 comprises a laminated material 50 with an inner heat-sealable layer 51 and an outer gas-impermeable layer 53. The inner layer has channels 52 formed at about a forty-five degree angle to edges 55, 57 of the material. The material may be folded and the edges heat sealed to form a tubular element. FIG. 5 also depicts the interaction of the inner faces 54 and 56 of the tubular element. Inner face 54 on the far side of the element has channels running at a forty-five degree angle and with the channels running from high on the left side to low on the right side. Inner face 56 on the near side of the tubular element also has channels running at a forty-five degree angle, but these channels run from low on the left side to high on the right side, that is, perpendicular to the channels on the other side 54 of the tubular element. These channels form a network of interconnected spaces and allow evacuation of the atmosphere when a vacuum is introduced at an end of the tubular element, providing of course, that the opposite end is sealed. There are other ways to form a tubular element from a single sheet. For instance, a single-layer or multi-layer material may be extruded in a closed shape, such as a shape having a cross-section of a circle or an ellipse. This method would produce a tubular element without the need for sealing at the edges, and would produce a tubular element without seams or seals on its sides.

While an angle of forty-five degrees for the channels may be used, other orientations to the edges of the material may also be used. For instance, a vertical orientation may be used on one panel and a horizontal orientation on the opposite panel or side of the container to be formed. Angles of five to eighty-five degrees may be used. In other embodiments, angles of thirty to sixty degrees may be used. What is important is that the channels on the first side interconnect with the channels on the other side of the container.

Figure 6:
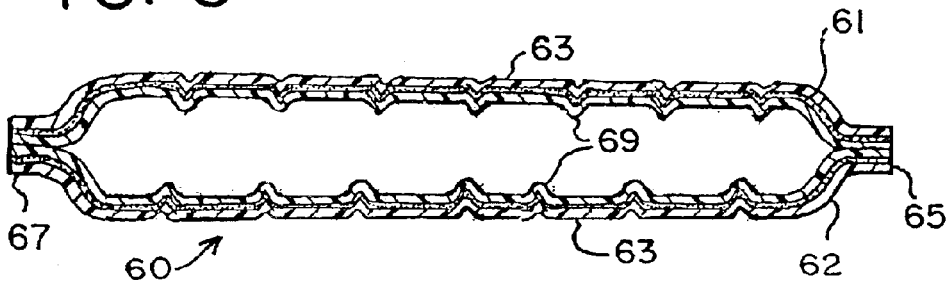
FIG. 6 is a cross-sectional view of an embodiment using two sheets of material.

Another tubular element may be formed from two sheets of layered material. As shown in FIG. 6, tubular element 60 comprises a first sheet 61 and a second sheet 62, sealed at their edges 65, 67 into a generally tubular shape. Each sheet 61, 62 is a laminated structure formed from an outer layer 63 of gas-impermeable material and an inner layer 69 of heat-sealable material. The channels are as described above, and when the two inner layers are compressed for vacuum packing or sealing, the channels prevent complete collapse of the inner surfaces, allowing for evacuation of the contents when the interior is subjected to a vacuum source. All the foregoing embodiments may be made using a single gas-impermeable, heat sealable material, such as polyethylene or nylon. Other embodiments may use a layered or laminated structure, such as one having nylon and polyethylene layers.

Figure 7:
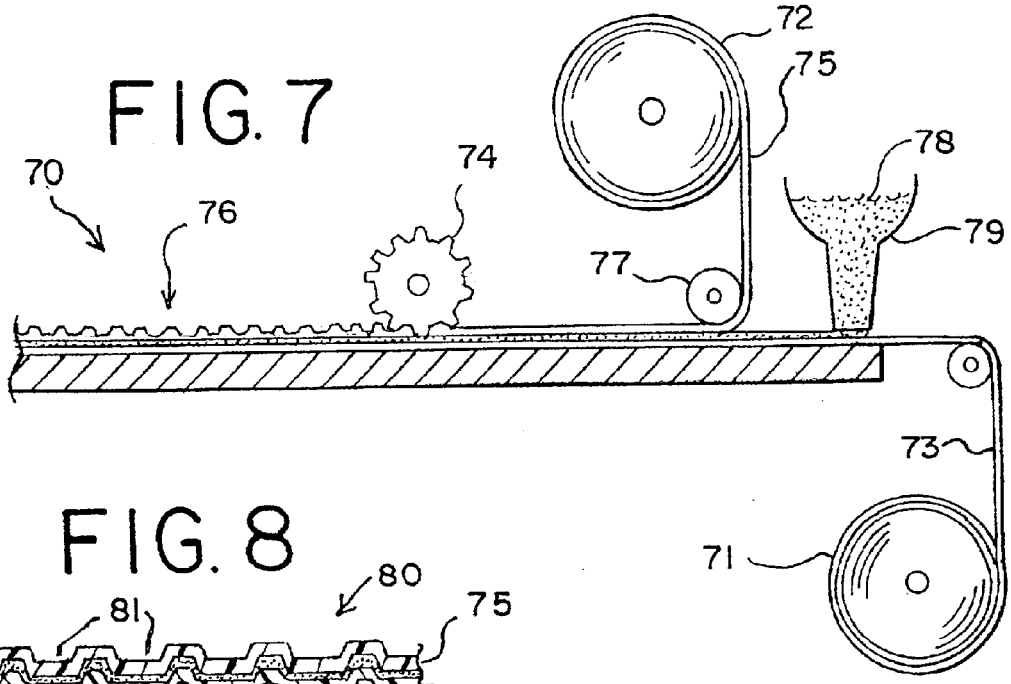
FIG. 7 is an elevational view of a process for making the embodiment of FIGS. 1 and 2.
Figure 8:
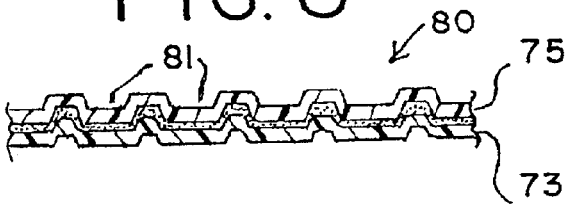
FIG. 8 is a closer view of a portion of FIG. 7.

The sheets of laminated material may be made by a variety of processes, one of which is illustrated in FIG. 7. Laminating machine 70 has a first reel 71 with gas or oxygen barrier material 73 and a second reel 72 of heat-sealable material 75. The laminating machine 70 unwinds gas barrier material 73 and coats the material with adhesive 78 from applicator 79. Heat sealable material 73 is bonded to the gas barrier material 73 with adhesive 78 and may also be bonded with heat and pressure from nip roll 77. The composite material may then be embossed by die 74 with a pattern of flattened channels at any angle as discussed above. Die 74 may use heat to help form channels onto the sheet. FIG. 8 provides a more detailed view of the composite material 80, with heat sealable material 75 and gas-barrier material 73, having channels 81 made by the laminator of FIG. 7.

Figure 9:
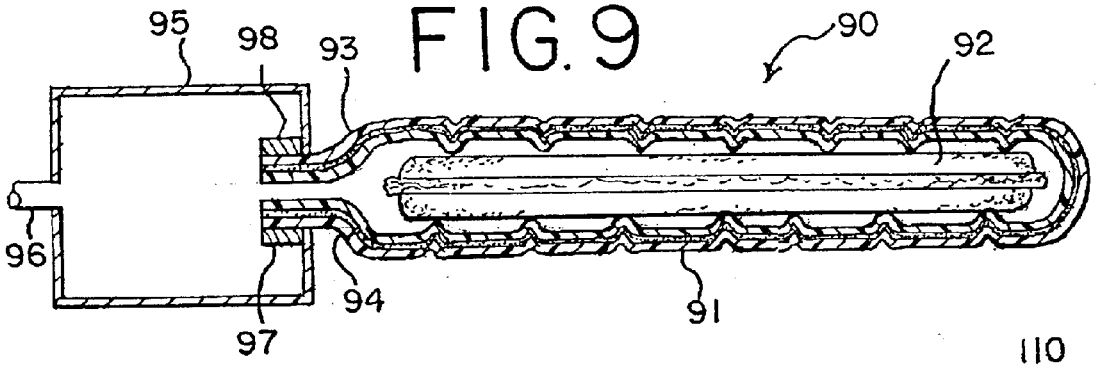
FIG. 9 is a cross-sectional view of an apparatus for sealing a container in accordance with the present invention.
Figure 10:
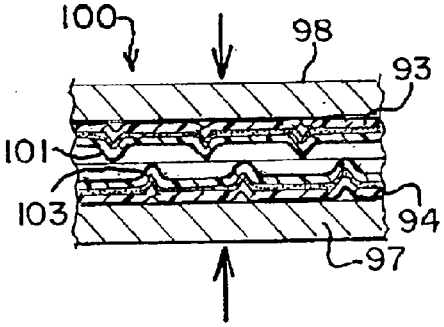
FIG. 10 is a closer, detailed view of a portion of FIG. 9.

The materials made into a layered or laminated structure may be used to store food or other products, as shown in FIG. 9. Product 92 has been placed in container 90, the container composed of two or more sheets 91 of laminated material as described above. The container 90 has top edges 93, 94 placed into a vacuum sealing apparatus 95 connected to a source 96 of vacuum, such as a vacuum pump or eductor. The sealing apparatus also has heating elements 97, 98 for sealing the container. FIG. 10 depicts a closer view of the sealing portion of FIG. 9. Edges 93 and 94 of the laminated material contain channels 101, 103, that intermingle to form an interconnected network inside the container. The vacuum source is used to evacuate the container and eliminate the oxygen or other gas inside the container. Later the container is sealed. Sealing elements 97, 98 may be heater elements capable of raising the temperature of the laminated material sufficiently so that the heat-sealable material flows under pressure and forms a seal, thus closing the container and preserving the product placed into the container.

It should be appreciated that the containers and processes of the present invention are capable of being incorporated in the form of a variety of embodiments, only a few of which have been illustrated and described above. The invention may be embodied in other forms without departing from its spirit or essential characteristics. For example, the channels, described as having been embossed onto the heat-sealable material, may instead be applied by an extrusion-type process, using heat and mechanical pressure rather than the mechanical pressure of an embossing die alone. While the composite material used for containers has been described as a two-layer material, other layers may be added, for instance an outer decorative layer or an additional outer layer to add mechanical strength to the container. The channels are described as being placed at about a forty-five degree angle from the longitudinal edges of the material; many other angles will also work well in forming an interconnected network of channels to aid in evacuation of the containers so formed.

Figure 11:
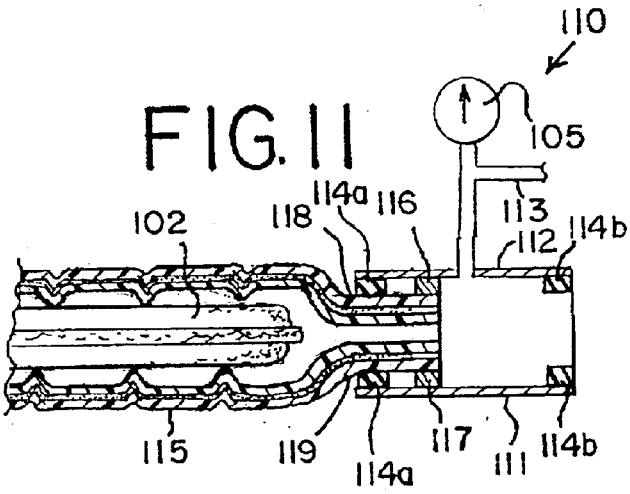
FIG. 11 is another embodiment of an apparatus for sealing a product in a container of the present invention.

Another device used to evacuate and seal the container may use separate sealing and heating devices. As shown in FIG. 11, sealing device 110 includes a sealing chamber lower portion 111, sealing chamber upper portion 112, vacuum source 113, sealing surfaces 114*a*, 114*b*, and heating elements 116, 117. In use, a perishable product 102 is placed into container 115. The upper edges 118, 119 of container 115 are placed into the sealing device 110. The edges 118, 119 are sealed by sealing surfaces 114*a*. The chamber may also be sealed by more sealing surfaces 114*b*. In some embodiments, sealing surfaces 114*a*, 114*b* may be gaskets between movable surfaces or portions of sealing device 110. The chamber and container are evacuated through vacuum source 113. When sufficiently evacuated, heating element 116, 117 may be heated to use the heat-sealable material to seal container 115 at upper edges 118, 119. The process of sealing may be controlled or monitored by a pressure/vacuum gauge 105. A controller (not shown) may be used to monitor the pressure/vacuum and control the timing of the sealing operation.

Figure 12:
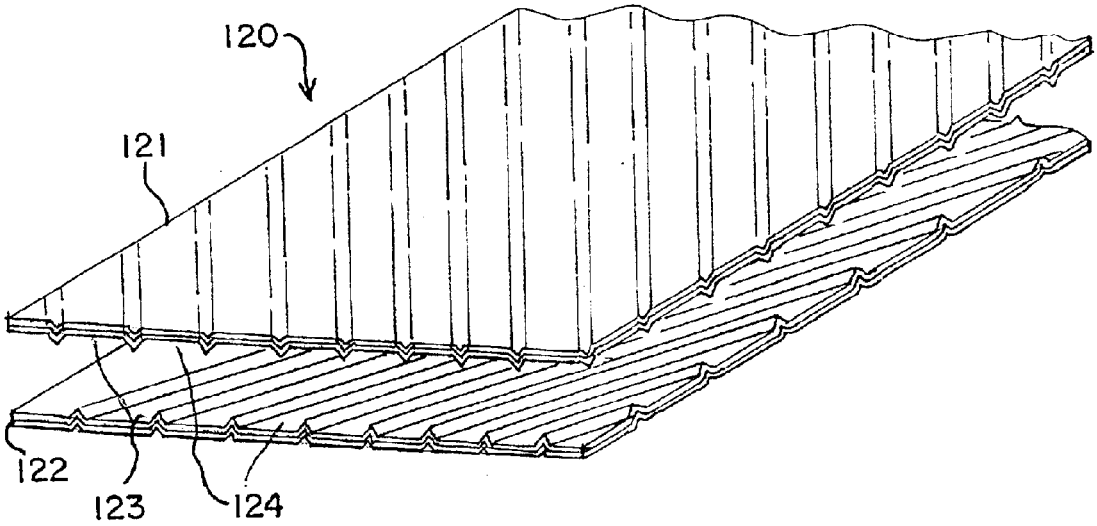
FIG. 12 depicts the network of channels for sealing.

When the two sides of a container or the top edges of a container contact each other, the channels form an interconnected network. This forms a network of spaces, through which the inside of the container may be evacuated. This situation is depicted in FIG. 12, in which two laminated materials 121, 122 have been joined at channels 123, leaving a network of spaces or voids 124. The network for evacuation will be as extensive as the properly-formed channels, and the evacuation will be as good as the network and vacuum source allow. Portions of the walls that stand out from the channels will provide a standoff from the food surface, allowing distant portions of the bag or container to be evacuated through the network.

Figure 13:
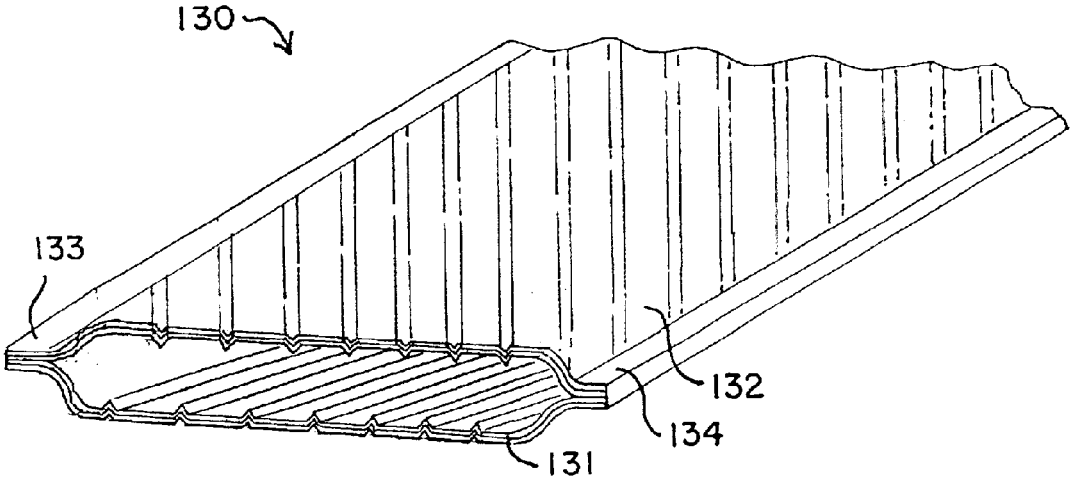
FIG. 13 is a perspective view of another embodiment of the present invention.

One container may be formed as a tubular element, depicted in FIG. 13. Tubular element 130 is comprised of a first sheet 131 of layered material and a second sheet of layered material 132. The two sheets are joined at edges 133, 134 by heat sealing the edges. The network depicted in FIG. 12 will extend throughout the tubular element formed. If the tubular element is formed by a continuous process, such as that depicted in FIG. 7, and sealed at its edges, tubular element 130 may be many feet long. Such a tubular element may subsequently be divided into smaller portions as desired, such as depicted in FIG. 9. Prior to storing a food or perishable item, a bag is cut off and the bottom is sealed to form a container sealed on three sides.

Figure 14:
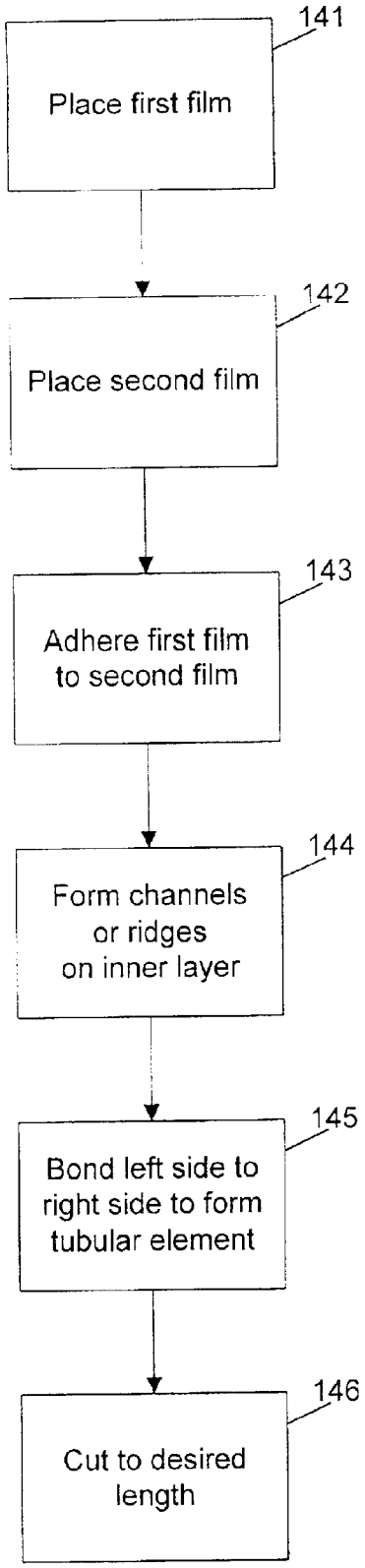
FIG. 14 is a flow chart for a method of producing the embodiments of FIG. 5.
Figure 15:
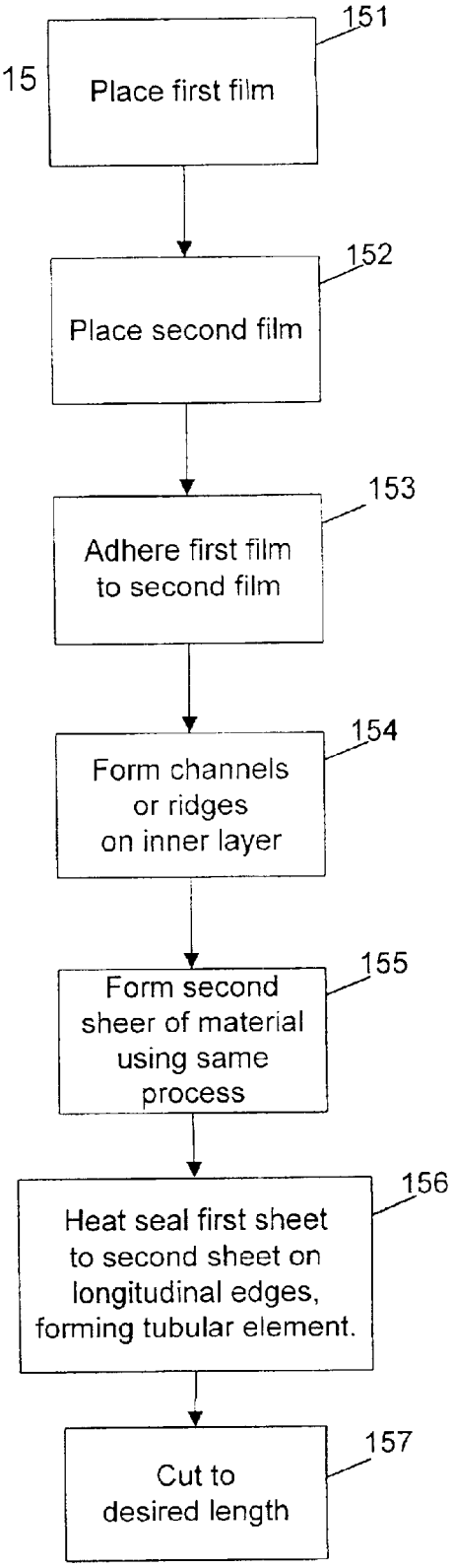
FIG. 15 is a flow chart for a method of producing the embodiments of FIGS. 6 and 13.

There are many processes that may be used to make the laminated material for containers for placing or storing a product. As outlined above, this process may take the form of using a single sheet of laminated material. A process may also use two sheets of laminated material to form tubular elements or containers. FIGS. 14 and 15 depict flowcharts for these processes. FIG. 14 is a flowchart for a process 140 for making a tubular element of storage material from a single sheet of laminated material. In the process, preferably a first film of gas-impermeable material is placed 141 for lamination. In the second step of the process, a second film of heat-sealable material is placed 142 for lamination. Alternately, a first film of heat-sealable material is placed and then a second film of gas-permeable material is then placed. The films are then adhered to each other 143, preferably with a thin layer of adhesive. This layer of adhesive is preferably stiffer than either of the layers of film.

The formed material is now processed to add the channels that make possible the network for evacuation. Channels are formed 144 in the heat-sealable side or inner surface of the material. The channels may be formed by heating and embossing or may be formed by extruding, or any other convenient process. In one embodiment, the channels extend over the entire width of the material. In another embodiment, an edge is left on either side of the material, the edge extending about ⅛" to ¼" (about 3 to 6 mm). Other, narrower or broader sealed edges may also be used. In the process of FIG. 14, a tubular element is to be made from a single sheet of material. Therefore, once the channels are formed, the left side of the material is bonded to the right side 145 to form a tubular element. The bonding is preferably accomplished with heat and a die, such as a roll-forming die, to bond the left side to the right side, forming a continuous open tube. The tube may then be rolled up for storage or transport, and later portions of tubular element may be cut to desired length 146 for storing a food product or other item.

FIG. 15 depicts an alternate process 150 for making a tubular element. In this process, preferably a first film of gas-impermeable material is placed for lamination 151. A second film of heat-sealable material is then also placed for lamination 152. Alternately, the first film may be the heat-sealable material and the second film may be the gas-permeable material. The first film is then adhered to the second film 153 to form a laminated material. Channels are then formed on the heat-sealable material 154, forming a first sheet of laminated material having a network of spaces joined for evacuation. A second sheet of material is then made 155 by a process very similar to the process discussed above for steps 151–154. The two sheets are then joined by their heat-sealable layers at the edges, forming a continuous tubular element 156. The tubular element may be of a discreet length or may be of a continuous, indeterminate length, made by a continuous process and placed into a roll or reel as it is made. Portions of the tubular element may then be cut to desired length and used to store a food item or other product.

Figure 16:
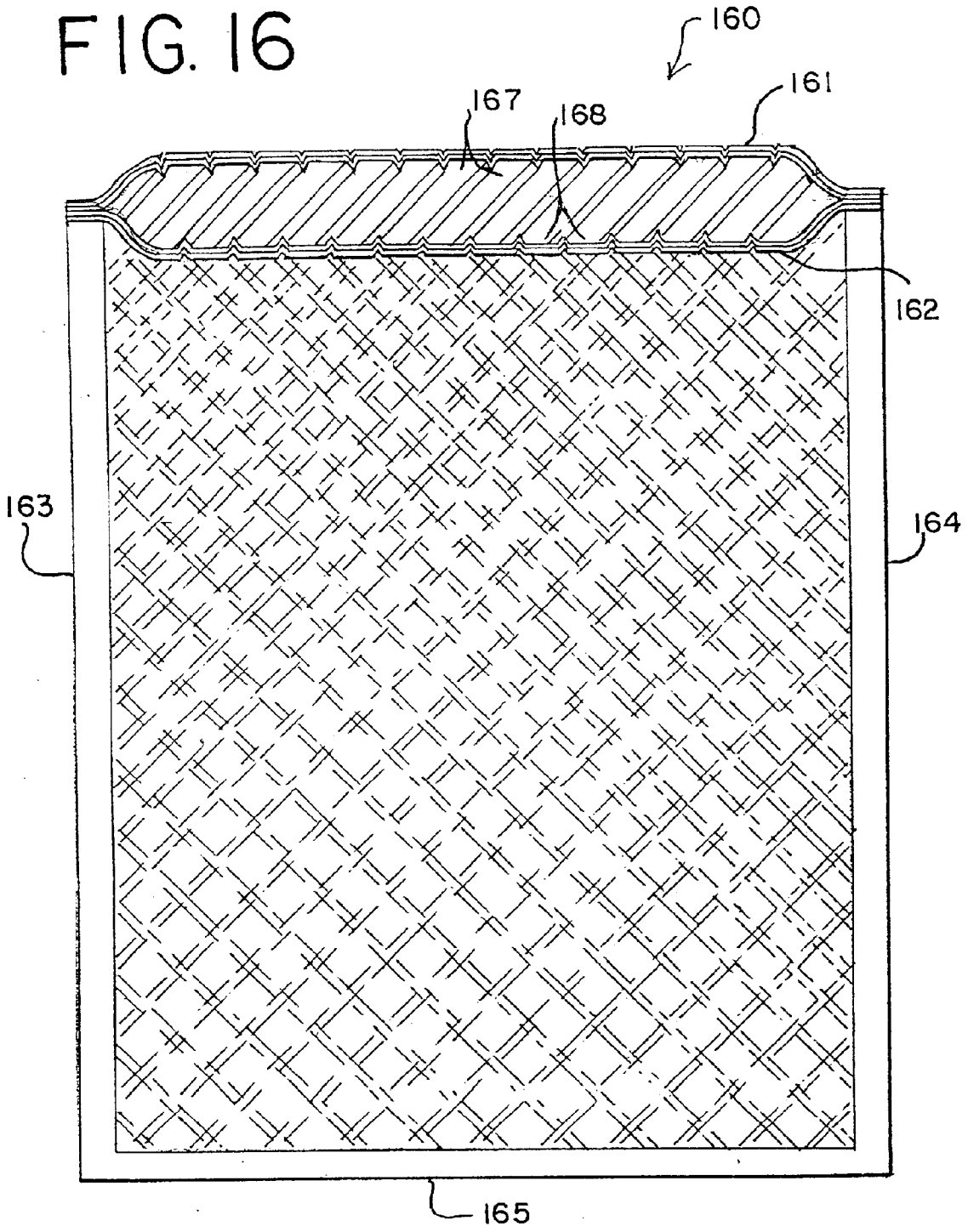
FIG. 16 is an additional embodiment made by the process of either FIG. 14 or FIG. 15.

A portion of the tubular element may then be processed to store an item. Container 160 is depicted in FIG. 16, as having been cut from a roll made by the process of either FIG. 14 or FIG. 15. Container 160 is formed from a back sheet 161 and a front sheet 162, having channels 167, 168, joined at left and right sides 163, 164 by the processes already described to form a tubular element. It is necessary to cut the desired length of container from a roll of material and then to seal the material at bottom edge 165 by any convenient means, such as heat sealing. The container is then ready for receiving an item for storage and for sealing the item in the container.

In addition to the embodiments discussed above, the invention may be practiced in a variety of other ways. FIGS. 17-23 depict several embodiments in which two sides of a container have different non-interconnecting channels formed, but which cooperate to leave air paths for evacuating the air in the container. The channels of the two panels are different, so that the channels will intersect and form air paths when the container is evacuated. The channels are preferably not parallel to either the sides or the top/bottom of the container, but may be at an angle, such as the forty-five degree angle described above. However, channels that are horizontal on one side of the container and vertical on the opposite side of the container may also cooperate in forming networks of spaces that may be used to evacuate the container. The angles of the channels may be from about five degrees to about eighty-five degrees to the sides of the container, preferably the angles may be from about thirty degrees to about sixty degrees, and most preferably, as discussed above, at about forty-five degrees. This may be convenient for manufacturing purposes. It will also be noted that when a panel of non-interconnecting channels is manufactured at a forty-five degree angle, and then folded in half upon itself, a network of interconnected channels is formed, even though the panels are identical, because the panels are at a different orientation to each other; in this case, approximately perpendicular. Other panels may also be manufactured that are seemingly similar or even alike, but which will form an interconnected network because of other orientation or spacing differences.

Figures 17A, 17B, 17C:
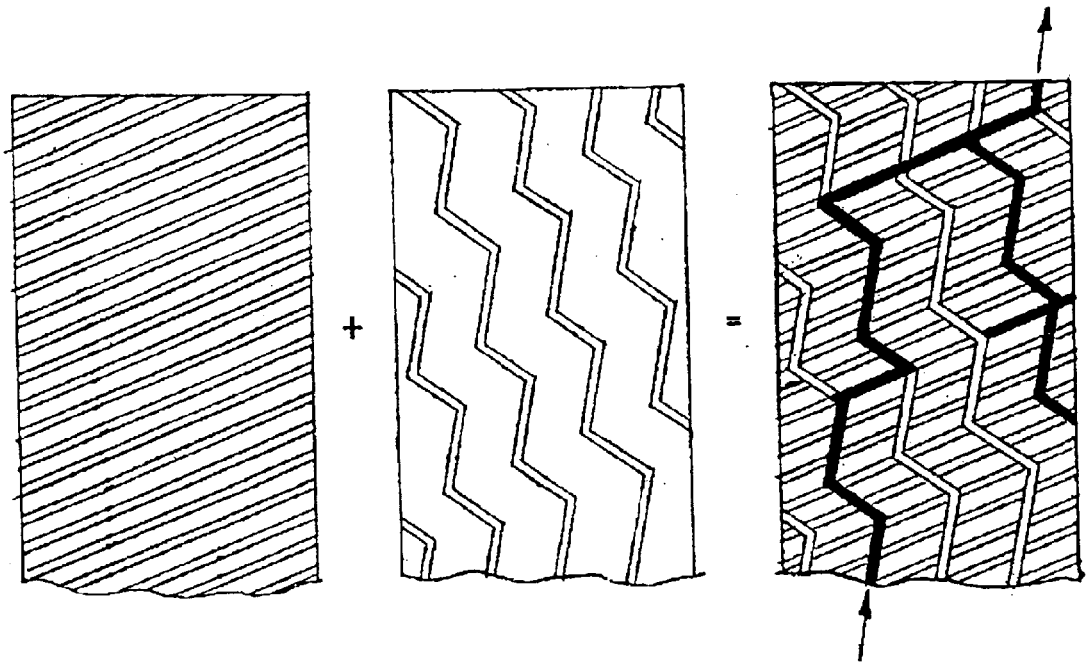
FIGS. 17*a*-17*c* depict an additional embodiment using different patterns of straight and wavy lines on the two sides of a container.

The panel of FIG. 17*a* has closely spaced parallel channels at an angle of from about 30 degrees to about 60 degrees from an edge of the container, while the container panel of FIG. 17*b* has widely-spaced parallel zig-zag lines that are not parallel to the channels in the panel of FIG. 17*a*. A container is made using the panel of FIG. 17*a* on one face and the panel of FIG. 17*b* on the other face. When the container is closed and the user evacuates the container comprising sides with channels according to FIGS. 17*a* and 17*b*, the sides of the container compress and form a pattern similar to that shown in FIG. 17*c*. Air paths are possible along the intersecting channels as shown by the entrance and exit arrows, and as shown by the bold line in FIG. 17*c*.

Figures 18A, 18B, 18C:
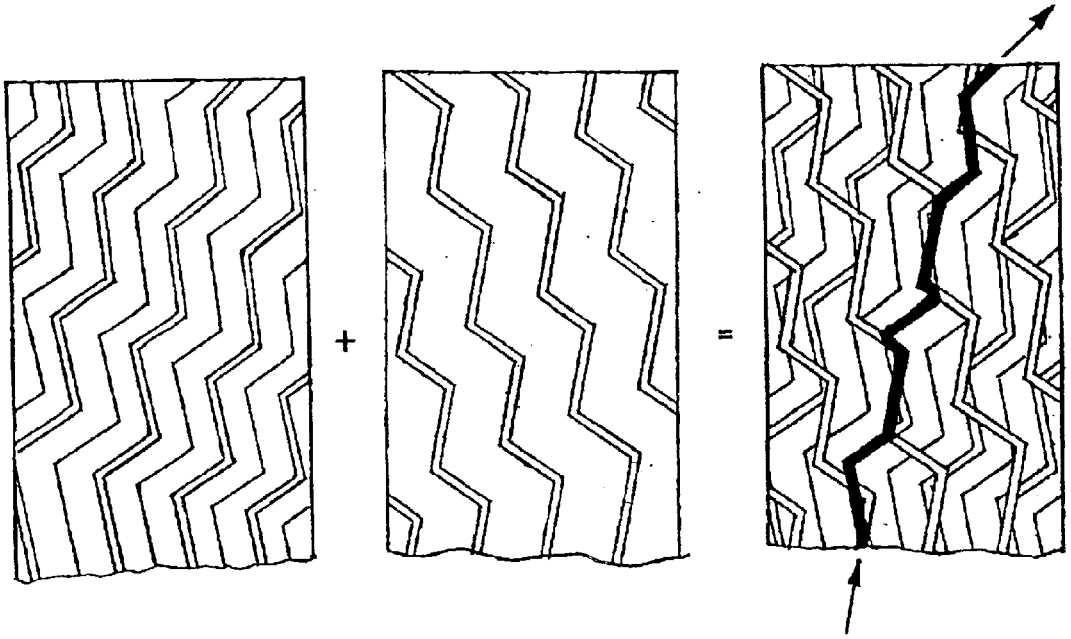
FIGS. 18*a*-18*c* depict an additional embodiment using different patterns of wavy channels on the two sides of a container.

Other embodiments are depicted in FIGS. 18*a*-18*c*. FIG. 18*a* is a first panel having closely spaced zig-zag channels, meant for use with a second panel shown in FIG. 18*b*, having more widely spaced zig-zag lines. When a container is made from these panels, and the user wishes to evacuate the container, the situation is as depicted in FIG. 18*c*: the bold lines (channels) and arrow depict air paths available along the intersecting channels. The panels are not limited to straight lines, or straight lines in sections, such as zig-zag lines. The zig-zag channel cannot be described as oriented at a single angle to an edge of the panel; however, over an interval of several zigs and zags, an estimate may be made, such as a least-squares best-fit estimate, of the slope of the zig-zag channel and its orientation with an edge of the panel. Such estimates may also be made for the orientation of other types of varying or variable channels.

Figures 19A, 19B, 19C:
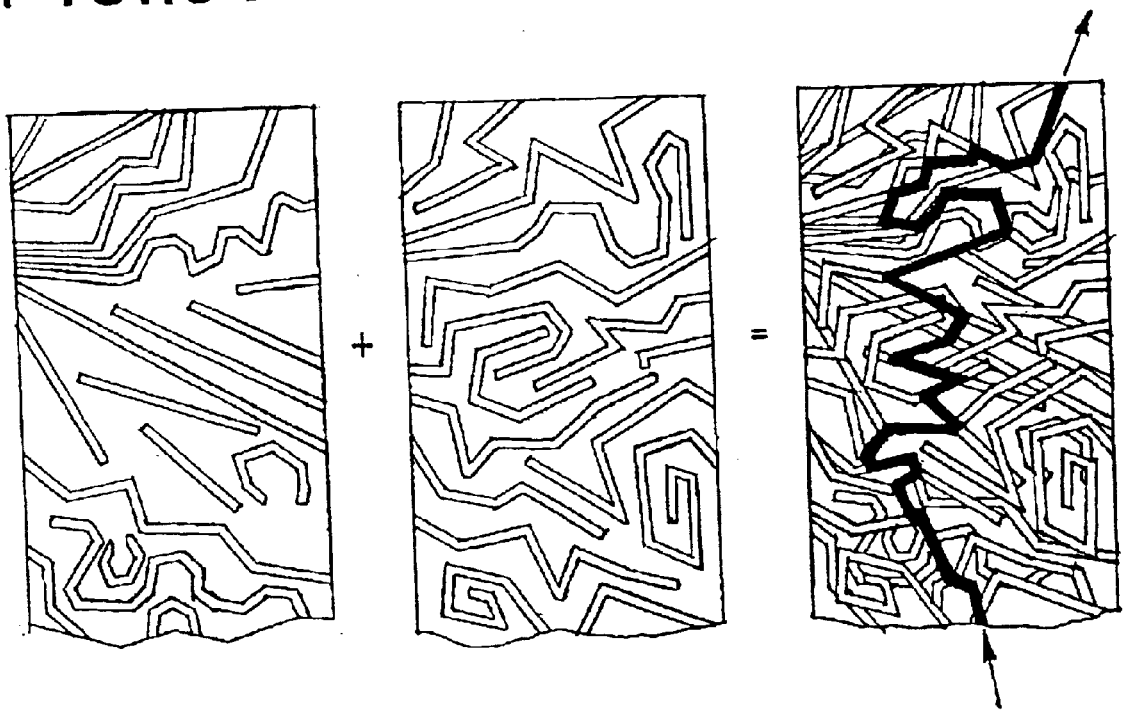
FIGS. 19*a*-19*c* depict an additional embodiment using different patterns of curling channels on the two sides of a container.

FIGS. 19*a*-19*c* illustrate how curling non-interconnecting channels can be used create interesting patterns (from a decorative point of view) that will also cooperate in creating air paths. Thus, the patterns shown in FIGS. 19*a* and 19*b*, on opposite sides of a container, may appear as depicted in FIG. 19*c*, with evacuation routes for air shown again in bold, with an arrow depicting a possible flow and evacuation route.

Figures 20A, 20B, 20C:
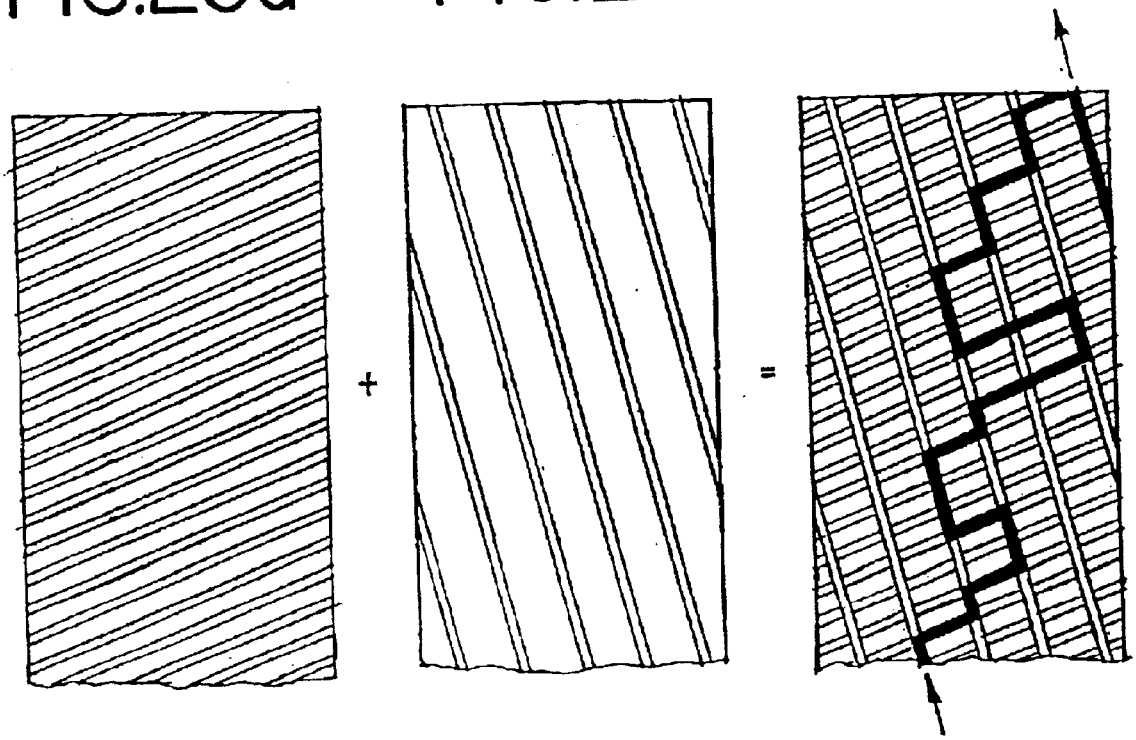
FIGS. 20*a*-20*c* depict an additional embodiment using different patterns of straight channels on the two sides of a container.
Figure 21A:
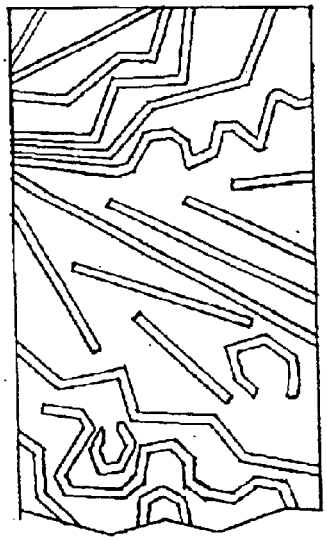
FIGS. 21*a*-21*c* depict an additional embodiment using a mixture of straight and curling channels on the two sides of a container.
Figure 21B:
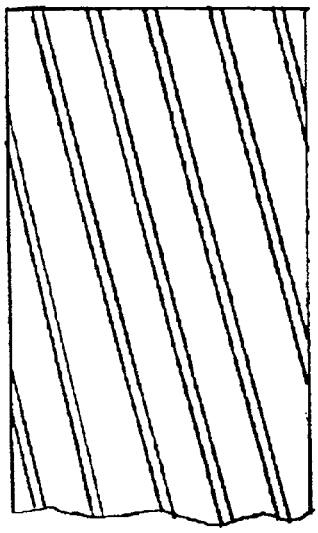
Figure 21C:
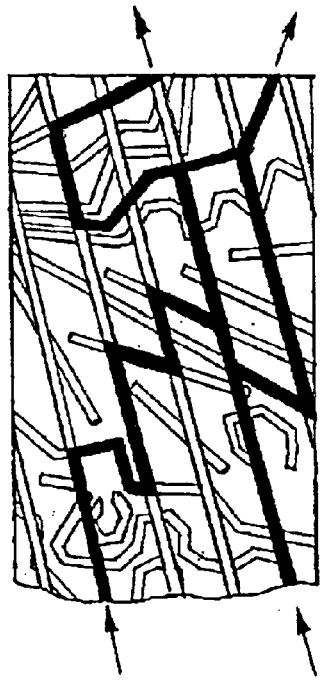
Figure 22A:
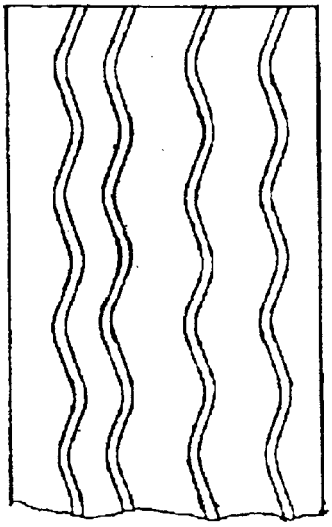
FIGS. 22*a*-22*c* depict another embodiment of channel patterns.
Figure 22B:
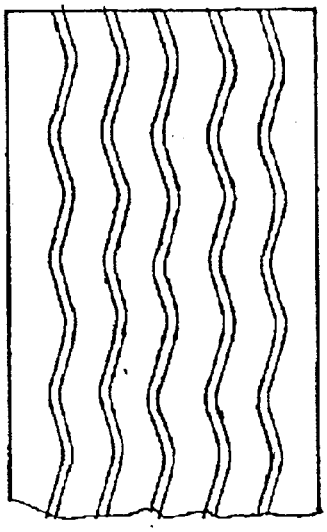
Figure 22C:
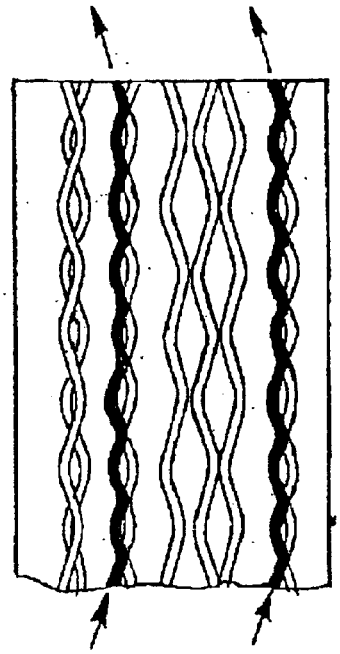
Figures 23A, 23B, 23C:
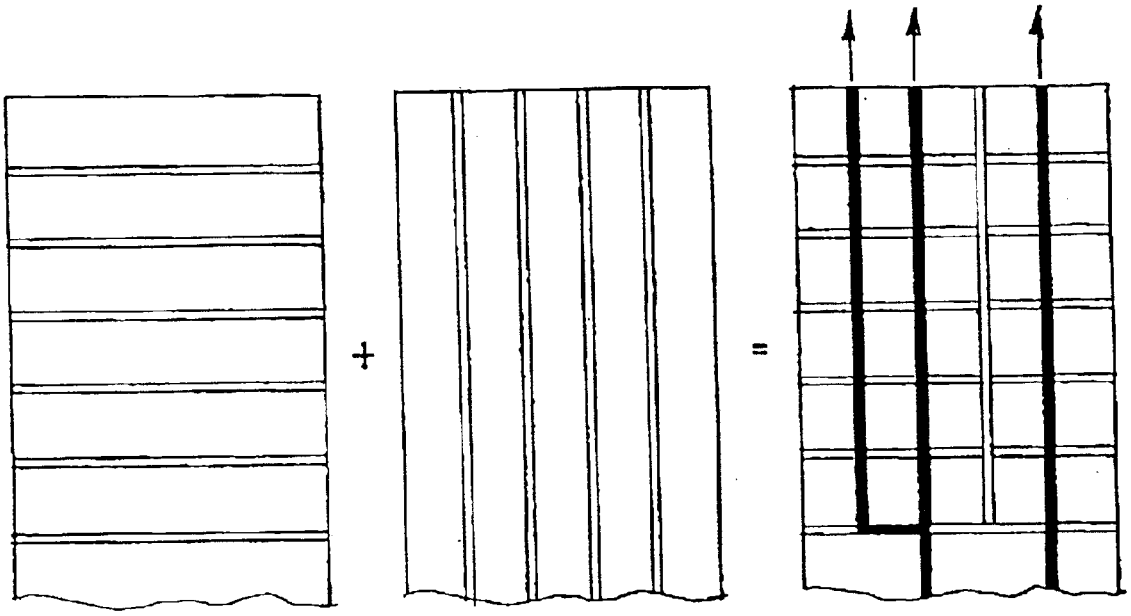
FIGS. 23*a*-23*c* depict an additional embodiment using vertical and horizontal channels.

FIGS. 20*a*-20*c* demonstrate that straight channels may be used also, in a variety of patterns, with an angled, closely spaced panel in FIG. 20*a* cooperating with a more widely-spaced, steeper-angled panel in FIG. 20*b*, to make a container with flow paths as shown in FIG. 20*c*. Other patterns, as shown in FIGS. 21*a*-21*c* are also possible, such as mixing the curling, variegated pattern of the panel of FIG. 21*a* with the channels of the panel of FIG. 21*b*, to create a container having flow paths that may appear as shown in FIG. 21*c*. The advantage of this pattern is that more of the surface area will be connected with the vacuum source. FIGS. 22*a*-22*c* depict another embodiment of channels, now wavy channels that are "out of phase" as shown in FIGS. 22*a* and 22*b*, and therefore intersect when brought together as in FIG. 22*c*. Finally, FIGS. 23*a*-23*c* depict the use of non-interconnecting horizontal channels and vertical channels in FIGS. 23*a* and 23*b*, to form an interconnected pattern in FIG. 23*c*.

The panels in FIGS. 17-23 have in common that the first panels, the "a" panels in each figure, are different from the "b" panels. The non-interconnecting channels in the two panels forming a container should be sufficiently different that when mated, the channels allow evacuation paths to form. Note that in the most preferred embodiment, the channels are not different, but rather are the same channels at a forty-five degree angle, but the orientation is changed so that the mating channels cooperate to form the required evacuation paths. Thus, as the above figures demonstrate, the panels that mate to form a container have channels that are different from one another in at least one of orientation and extent, to allow formation of evacuation routes under vacuum. Orientation means the angle of the channel with a side edge of the panel; extent means the length of the channel. Note that the orientation of a first network may be at an angle to the orientation of the second network, and that the orientation may be at any angle.

Yet another embodiment of the invention may be considered an improvement to existing storage containers. The container is of a type comprising first and second rectangular gas-impermeable panels, each defining inner and outer surfaces and both panels sealingly joined together at three common adjacent peripheral edges and not joined at a fourth peripheral edge. Joining the panels forms a gas-impermeable container having an interior chamber and an open edge for placing a product therethrough and into the interior chamber. An improvement to the container comprises a first network of non-interconnected channels on the inner surface of the first panel and a second network of non-interconnected channels on the inner surface of the second panel, wherein said channels of said first network communicate with said channels of said second network when the first and second panels are joined, to form a master network of interconnected channels in communication with the open edge to allow gas to be withdrawn therethrough from the interior of the container.

One way to consider the invention is that the various embodiments and methods described herein feature depressions or channels embossed or formed in the heat-sealable layer. The channels on each panel, or on each side of the container, are not interconnected, as shown in FIGS. 17-23. When an object for storage is placed into the container, the sides may come together, as when the container or storage bag is closed. The bag may be closed for evacuation of the air therein to prolong the storage life of the object. When the sides of the bag come into contact, only then do the channels on the two sides interconnect, forming a master network of channels to evacuate the air or other gas in the container or storage bag.

There are many ways to practice the invention. As discussed above, a variety of materials and thicknesses may be employed in both the heat-sealable layer and the gas or oxygen-impermeable layer. Other layers may be added to these layers, preferably on what will be the outside of the container, for instance, decorative or further protective layers. It will be appreciated that the addition of other process steps, materials or components not specifically included may also be used in the present invention. However, the described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope. Accordingly, it is the intention of the applicants to protect all variations and modifications within the valid scope of the present invention.

I claim:

1. In a container of the type comprising first and second rectangular gas-impermeable panels, each defining inner and outer surfaces and both sealingly joined together at three common adjacent peripheral edges and not joined at a fourth peripheral edge to form a gas-impermeable container having an interior chamber and an open edge for placing a product therethrough and into the interior chamber, the improvement comprising:

a first network of non-interconnected channels on the inner surface of the first panel; and a second network of non-interconnected channels on the inner surface of the second panel, wherein said channels of said first network communicate with said channels of said second network when the first and second panels are joined, to form a master network of interconnected channels in communication with the open edge to allow gas to be withdrawn therethrough from the interior of the container.

2. The container of claim 1 wherein the first network comprises at least one of curvilinear continuous channels and curvilinear discontinuous channels.

3. The container of claim 1 wherein the first network comprises continuous, parallel straight channels.

4. The container of claim 3 wherein the second network comprises parallel straight channels at an angle from the first network, the angle selected from forty-five to ninety degrees.

5. The container of claim 1 wherein the first and second panels further comprise a gas-impermeable outer layer and a heat-sealable inner layer.

6. The container of claim 1 wherein the first network comprises parallel, continuous curvilinear channels.

7. The container of claim 6 wherein the second network comprises parallel, continuous curvilinear channels at an angle from the first network, the angle selected from forty-five to ninety degrees.

8. The container of claim 1 wherein the first network comprises zig-zag channels formed at an angle of from about five degrees to about eighty-five degrees to an edge of the container.

* * * * *